United States Patent [19]

Van Gils

[11] Patent Number: 4,522,036

[45] Date of Patent: Jun. 11, 1985

[54] COOLING DEVICE

[75] Inventor: Antonius C. M. Van Gils, Etten-Leur, Netherlands

[73] Assignee: IE PE GE B.V., Etten-Leur, Netherlands

[21] Appl. No.: 435,248

[22] Filed: Oct. 19, 1982

[51] Int. Cl.[3] ..... G05D 23/32

[52] U.S. Cl. ..... 62/157; 55/302; 62/231; 165/97

[58] Field of Search ..... 55/302; 62/234, 231, 62/157; 165/95, 97, 121

[56] References Cited

U.S. PATENT DOCUMENTS

| | | | |
|---|---|---|---|
| 1,967,019 | 7/1934 | Buchanan . | |
| 2,525,462 | 10/1950 | Shell . | |
| 2,954,873 | 10/1960 | Davis | 55/302 |
| 3,612,616 | 10/1971 | Stewart | 55/302 X |
| 3,675,437 | 7/1972 | Linstromberg | 62/233 X |
| 4,102,393 | 7/1978 | Withers, Jr. | 165/97 X |

*Primary Examiner*—William E. Wayner

*Attorney, Agent, or Firm*—Diller, Ramik & Wight

[57] ABSTRACT

A cooling device for use in ale coolers, automatic beverage machines, air-conditioning apparatus or the like, said cooling device mainly comprising a series-connected evaporator 3, a compressor 4, a lamella condensor 5 and an air displacing member 6 for generating a cooling air stream P along the condensor lamellae, wherein means, such as a polarity commutating electric motor or flaps, for inverting the direction of flow of the cooling air along the condensor lamellae at periodical intervals in order to blow back the dust deposited on the lamellae and to conduct it to the outside.

1 Claim, 6 Drawing Figures

Figure 3A:
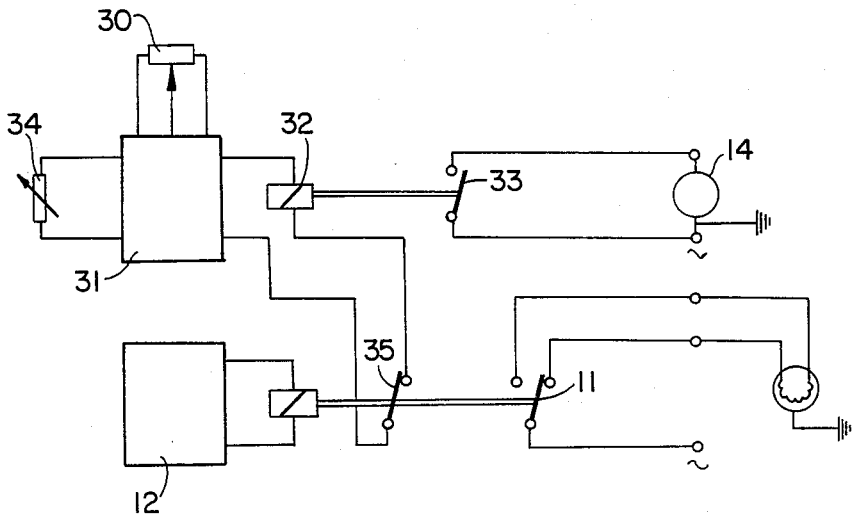

FIG. 1
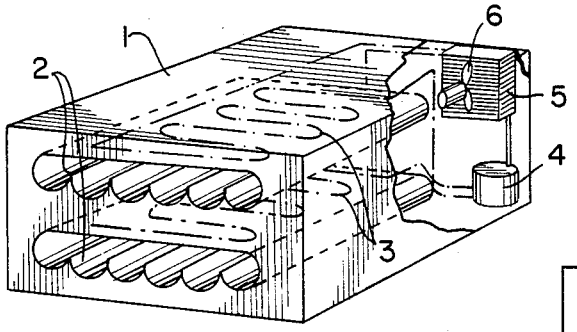
FIG. 2
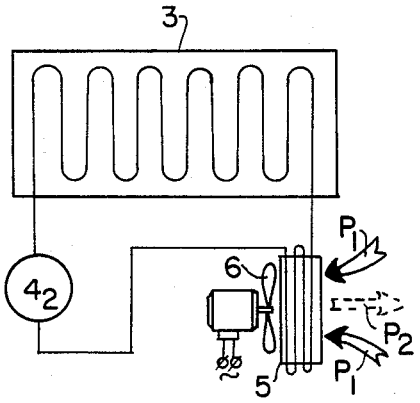
FIG. 3
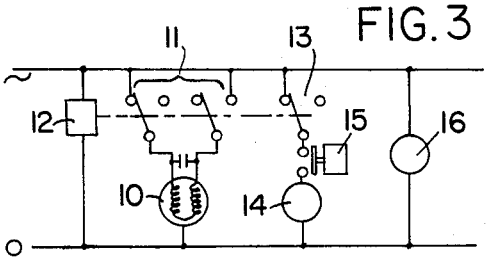
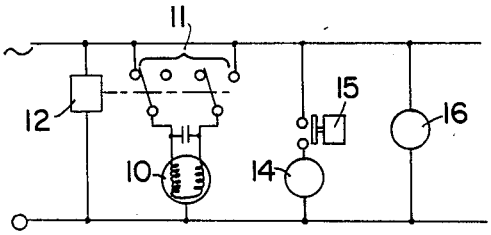
FIG. 4
FIG. 5
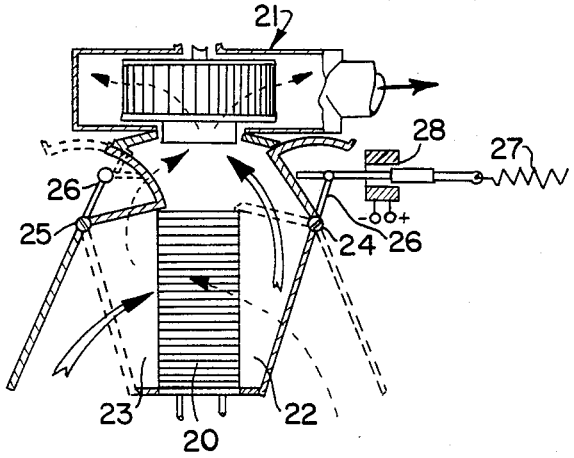

COOLING DEVICE

The invention relates to a cooling device for use in ale coolers, automatic beverage machines, air-conditioning apparatus or the like, said cooling device mainly comprising a series-connected evaporator, a compressor, a lamella condensor and an air displacing member for generating a cooling air stream along the condensor lamellae.

Such a cooling device is usually incorporated in bars or cabinets and the like and are, therefore, difficult of access for cleaning purposes. This is particularly troublesome in cleaning the lamellae of the condensor, which has to be done at regular intervals because the air stream carries along an amount of dust and/or dirt which settles on the lamellae of the condensor. Filthiness of the condensor brings about a decrease in refrigerating capacity of the condensor so that the compressor has to run longer for the required cooling effect and the energy consumption of the device increases. Moreover, with an increasing fouling the compressor pressure tends to increase to an extent such that the compressor motor coils may burn through.

The invention has for its object to obviate the aforesaid disadvantage by providing a cooling device which is distinguished by means for inverting the direction of flow of the cooling air along the condensor lamellae.

Owing to this inversion of the cooling air stream the dust deposited on the lamellae is blown back and conducted to the outside.

In one embodiment of air displacing member is constructed in the form of an axial blade rotor driven by a polarity commutating electric motor and the inverting means in the form of an electric switch controlled by a cycle generator. The cycle generator provokes an inversion of the polarity circuit in the electric motor so that the latter starts rotating in the reverse direction and owing to the opposite direction of rotation the axial blade rotor blows the air back.

In a further embodiment the air displacing member is formed by an axial blade rotor driven by a polarity commutating electric motor, in which the inverting means are formed by a switching mechanism for varying the position of the blades of the rotor.

According to a further aspect the air displacing member is an axial or a radial rotor connected with a channel system that can be blocked by flaps and conducting to both sides of the condensor, said flaps being controlled by a time control. The flaps are disposed so that either one channel or the other is opened so that either one side or the other of the condensor is linked to the rotor.

It is preferred to control at the same time the thawing cycle of the evaporator by means of the cycle generator or the time control so that during thawing of the evaporator the cooling air stream across the condensor is inverted and the condensor is blown clean.

When the sense of rotation of the rotor or, respectively, the setting of the blades of the rotor in inverted, it is preferred to use a higher rotor speed than during the normal cooling cycle.

The invention will be described more fully with reference to a few embodiments.

The drawing shows in:

FIG. 1 a perspective view of a refrigerator for bottles comprising a cooling device embodying the invention, FIG. 2 a schematic view of the cooling device employed in the refrigerator of FIG. 1, FIGS. 3 and 4 two circuit diagrams suitable for use in the cooling temperature control for the compressor, FIG. 3*a* an alternative circuitry comprising a series-connected temperature control for the compressor motor FIG. 5 a further embodiment of a condensor with a rotor and a channel system for the cooling air.

The refrigerator 1, shown only by way of example, comprises spaces 2 to the front for holding, for example, bottles. The spaces are cooled on the top side by a cooling element or evaporator 3 of a conventional kind, in which a fluid is circulating by means of a compressor 4. In the fluid circuit is included in series a condensor 5, in which the heat withdrawn from the compartment 2 is transferred to the ambient air. In order to increase the capacity of the condensor 5 it is equipped with lamellae, an air displacing apparatus 6 being provided to blow an air stream along the lamellae.

FIG. 2 schematically shows the arrangement, the same reference numerals being used for corresponding elements.

The invention now proposes to periodically invert the normal cooling air stream in the direction indicated by the arrow P1 (see the arrow P2) in order to blow back the dust or dirt particles back.

The air stream can be inverted in various ways, for example, by means of an electric switching system, which is described more fully with reference to FIGS. 3 and 4.

For such a system the driving motor of the air displacing member formed by a blade rotor has to be commutatable in polarity for inverting the direction of rotation of the rotor in the electric motor. Such a polarity commutating motor is designated by reference numeral 10 in FIGS. 3 and 4. The change-over of polarity is performed by means of an electric switch 11, which is controlled by a cycle generator 12. The cycle generator may be of a conventional type, for example, a switching roller or an electronic switching block. The switching block has a definite time constant so that after a given period, for example, of six hours the switch 11 remains changed over for 15 minutes, the sense of rotation of the rotor in the electric motor then being inverted as a result of which direction of flow of the air along the lamellae of the condensor 6 is also inverted.

When the cycle generator 12 only controls the electric motor 10, the cooling device may be used, for example, in an ale cooler because no thawing cycle is required in this case. This is illustrated in the diagram of FIG. 4.

FIG. 3 shows a circuit diagram in which the cycle generator 12 controls, in addition, a switch 13 of a compressor 14. In such an embodiment the cooling device may be employed, for example, in the refrigerating system of FIG. 1, in which a thawing cycle has to be periodically carried out in order to remove ice depositions on the evaporator. For this purpose the cycle generator can each time cut off the compressor and during this period the blower is automatically inverted for blowing the condensor lamellae clean.

For completeness' sake a safety thermostat for the compressor is shown at 15. Reference numeral 16 designates an electric blower motor which serves, for example, for transporting the cooled air in the compartment of the refrigerator or for driving a stirrer.

FIG. 3*a* shows a temperature-controlled motor of the compressor, in which the setting 30 tends to maintain a given temperature in the cooling space by the control means of the control-block 31. When the given temperature is reached, the switch 33 of the compressor motor 14 is cut off by the solenoid 32 so that the cooling process stops. As soon as the temperature sensor 34 detects a deviation in the cooling space the block 31 re-actuates the motor 14 through the solenoid 32.

Independently thereof the cycle generator 12 brings about the desired thawing and cleaning cycle respectively of the cooling space or the lamellae of the condensor respectively. The latter process described is achieved by inverting the polarity commutating motor 10. By changing over the switch 11 the motor is controlled, whilst the switch 35 puts the solenoid 32 out of operation so that the switch 33 is changed over and the compressor motor 14 is switched off. This control illustrates that even in periods in which cooling is necessary for a long time and the compressor motor 14 is continuously running for a long time the thawing and cleaning processes are nevertheless ensured thanks to the cycle generator, which results in a decrease of the overall energy expenses.

FIG. 5 is a schematic view for a mechanical inversion of the air stream along the lamellae of the condensor 20, on both sides of which is connected a channel system. The channel system conducts to a radial blade rotor 21, which can be rotated by an electric motor (not shown). Each channel 22 and 23 is provided with a flap system 24 and 25 respectively, which can be turned over by a mechanical leverage 26 (see the solid and broken lines respectively in the figure). The leverage 26 may be biassed by a tensile spring 27 and it can be shifted by a solenoid 28 acting against the tensile strength of the spring 27. The solenoid can be energized by a time control, for example, the cycle generator 12 of FIGS. 3 and 4.

From this figure it will be apparent that in one position of the leverage channel 23 communicates with the blower 21, whereas channel 22 communicates with the open air and that after a change-over channel 22 communicates with the blower and channel 23 is opened to the ambience.

The invention is not limited to the embodiments described above.

What is claimed is:

1. In a cooling system having compressor means, evaporator means for cooling a space and a lamella condensor for circulating refrigerant in a closed path, air displacing means for directing air normally in one direction over said lamella condensor to abstract heat from refrigerant flowing therethrough, and thermostat means for controlling said compressor means in response to temperature variations in said space being cooled, the improvement which comprises cycle means for cyclically causing air to flow over said lamella condensor in direction opposite said one direction independently of operation of said thermostat means whereby cyclic flow of air in said opposite direction over said condensor occurs even when cooling of said space is continuously demanded over a long period of time, including switch means for deenergizing said compressor means independently of said thermostat means so as to thaw said evaporator means, said cycle means periodically actuating said switch means so as to cause said compressor means to be deenergized.

* * * * *